US005595490A

United States Patent [19]

Cohen et al.

[11] Patent Number: 5,595,490

[45] Date of Patent: Jan. 21, 1997

[54] PRINTED CIRCUIT BOARD CONNECTORS

[75] Inventors: Thomas S. Cohen, New Boston, N.H.; Philip T. Stokoe, Attleboro, Mass.

[73] Assignee: Teradyne, Inc., Boston, Mass.

[21] Appl. No.: 372,494

[22] Filed: Jan. 13, 1995

[51] Int. Cl.[6] ..... H01R 9/09

[52] U.S. Cl. ..... 439/74; 439/947; 439/660

[58] Field of Search ..... 439/284, 65, 76, 439/660, 295, 346, 74, 947

[56] References Cited

U.S. PATENT DOCUMENTS

| | | | |
|---|---|---|---|
| 3,609,463 | 9/1971 | Laboue | 439/65 |
| 4,973,270 | 11/1990 | Billman et al. | 439/630 |
| 5,161,985 | 11/1992 | Ramsey | 439/284 |
| 5,171,154 | 12/1992 | Casciotti et al. | 439/67 |
| 5,310,357 | 5/1994 | Olson | 439/346 |

FOREIGN PATENT DOCUMENTS

| | | | |
|---|---|---|---|
| 125780 | 11/1984 | European Pat. Off. . | |
| 378819 | 7/1990 | European Pat. Off. . | |
| 658951 | 6/1995 | European Pat. Off. . | |
| 3933658A1 | 10/1989 | Germany . | |
| 0752551 | 7/1980 | U.S.S.R. | 439/660 |

OTHER PUBLICATIONS

Advertisement from *Surface Mount Technology Source Book* entitled "Samtec Announces New SMT Products and Services".

Collins, Henry, "This connector mounts on the board side".

"EIA Standard Draft Document For 1.0 mm Pitch, Two-Part Connectors For Use With Parallel Printed Boards", Oct. 1, 1993, Revision 1.0.

*Primary Examiner*—Neil Abrams
*Assistant Examiner*—Eugene G. Byrd

[57] ABSTRACT

A PCB connector in which single insulating housings may carry both pad contact elements and beam contact elements to be supportable in opposed differently oriented pairs for beam to pad matable contact.

35 Claims, 13 Drawing Sheets

PRINTED CIRCUIT BOARD CONNECTORS

FIELD

This invention relates to connectors for printed circuit boards ("PCB"s), and more particularly to such connectors which include pressure mounted contacts.

BACKGROUND

Printed circuit board connectors are known in which two relatively movable insulating housings carry as contact elements respectively conductor pads (or "blades") and conductor cantilever beams carrying pressure mounted surfaces, mounted on the housings for wiping engagement of contact surfaces of the pads and beams as the connectors are moved in a connector-mating direction.

SUMMARY

We have discovered that a PCB connector element may desirably be provided with a plurality of sets of contact elements secured in a housing with contact surfaces of the contact elements facing away from the housing. In a preferred embodiment, the sets are arranged in rows spaced transversely of the housing, one set is of leaf spring cantilever beam contact elements with one end held in the housing, and the other set is surface mounted on the housing, with its ends held in the housing, contact elements of one set alternating longitudinally of the housing with contact elements of the other set.

We have also discovered that a PCB connector element may desirably be provided with a pressure-mounted contact element, the contact element being a leaf spring cantilever beam with one end held in a housing, the beam being stressed into strain by an abutment in the housing limiting movement of the other end. In a preferred embodiment the beam portion between the held end and a contact surface portion has a cross-sectional area diminishing in the direction from the fixedly mounted end toward the contact portion, and the contact surface portion extends away from the housing through a hole therein.

We have discovered also that a PCB connector may be provided which includes two connector elements mounted in relation to each other such as to matingly engage another PCB connector also having two connector elements, connector elements of one PCB connector including daughter board leads arranged to engage daughter board surface mounted contacts to provide a daughter board connector and connector elements of the other PCB connector including backplane leads adapted to engage backplane surface mounted contacts, to provide a backplane connector. In a preferred embodiment, the backplane connector has a central spine on which transversely opposed connector elements are carried and the daughter board connector has transversely spaced pairs of connector elements mounted on spacers corresponding in thickness functionally to the overall thickness of the backplane connector.

We have discovered further that a PCB connector element may be desirably supplied in the form of a longitudinally extending support carrying a pair of transversely spaced housings each carrying transversely accessible contact surfaces. In preferred embodiments, one such connector element is transversely spaced by a spine on which housings are mounted and the other such connector element has housings held in spaced relation by spacers, the spacers having longitudinal edge ribs slidably fitting in tracks of mounting ribs, and the spined connector element being matably engageable with the spacer connector element, whereby on mating contact surfaces of the spine connector element wipingly engage contact surfaces of the spacer connector.

PREFERRED EMBODIMENTS

We turn now to description of preferred embodiments in the light of the following drawings.

DRAWINGS

STRUCTURE

A connector assembly (indicated generally at 10 in FIG. 1) includes a backplane connector indicated generally at 12 and a daughter board connector indicated generally at 14.

Figure 1:
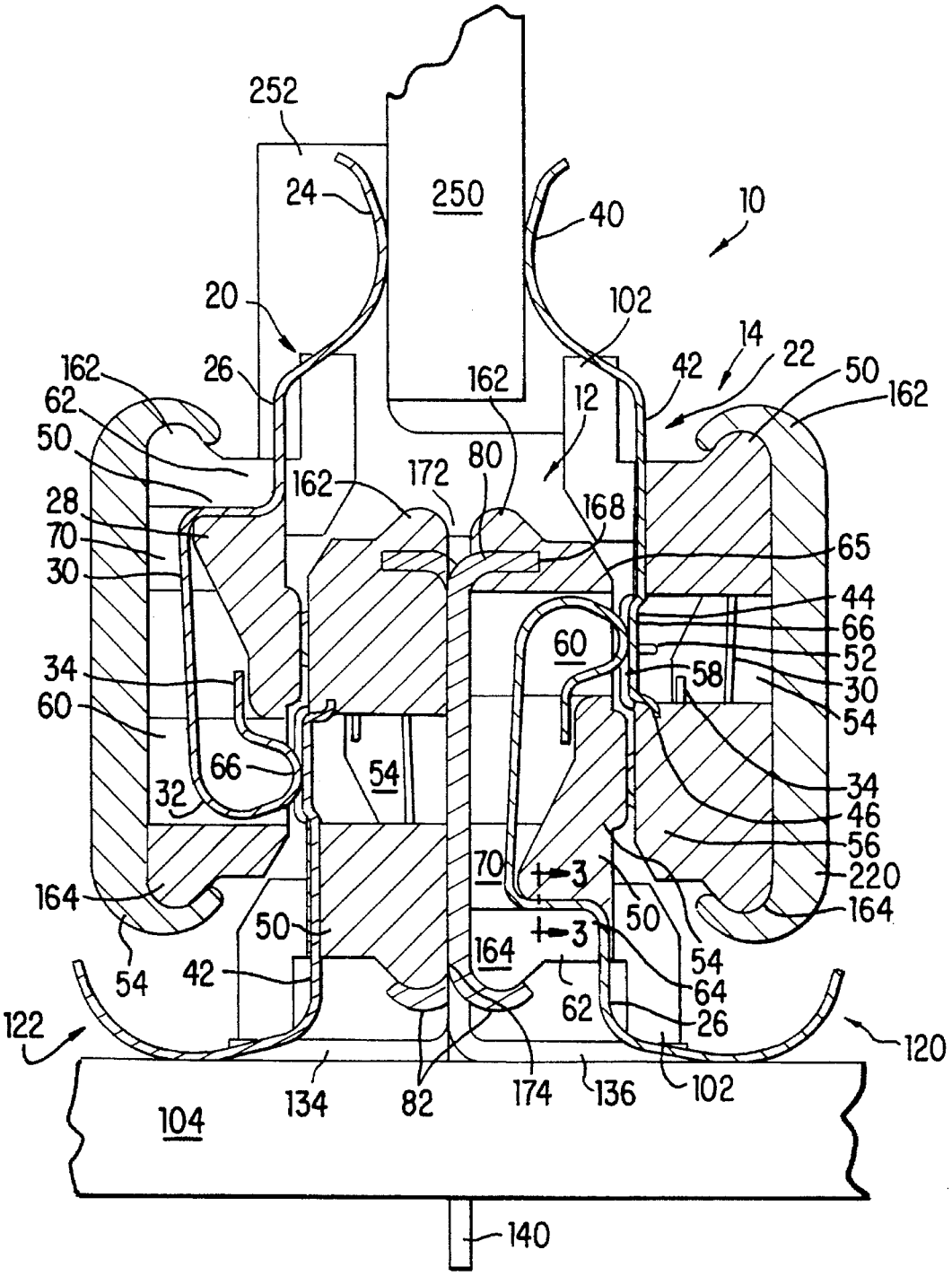
FIG. 1 is an enlarged sectional view of the preferred embodiment, taken at 1—1 of FIGS. 6 and 8.

Backplane connector 12 and daughterboard connector 14 each includes a multiplicity of contact elements 20 and 22, one of each of which is shown in FIG. 1.

Figure 3:
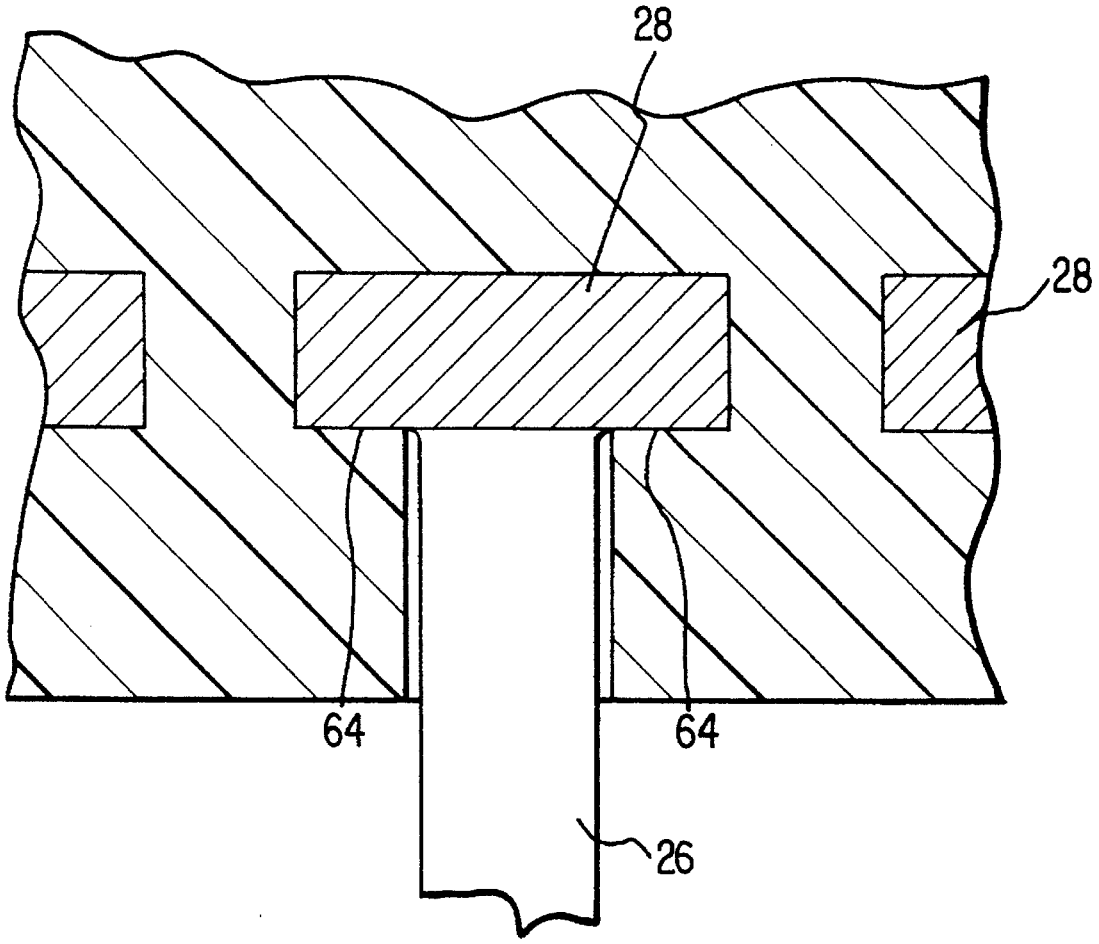
FIG. 3 is a broken-away sectional view taken at 3—3 of FIG. 1.
Figure 4:
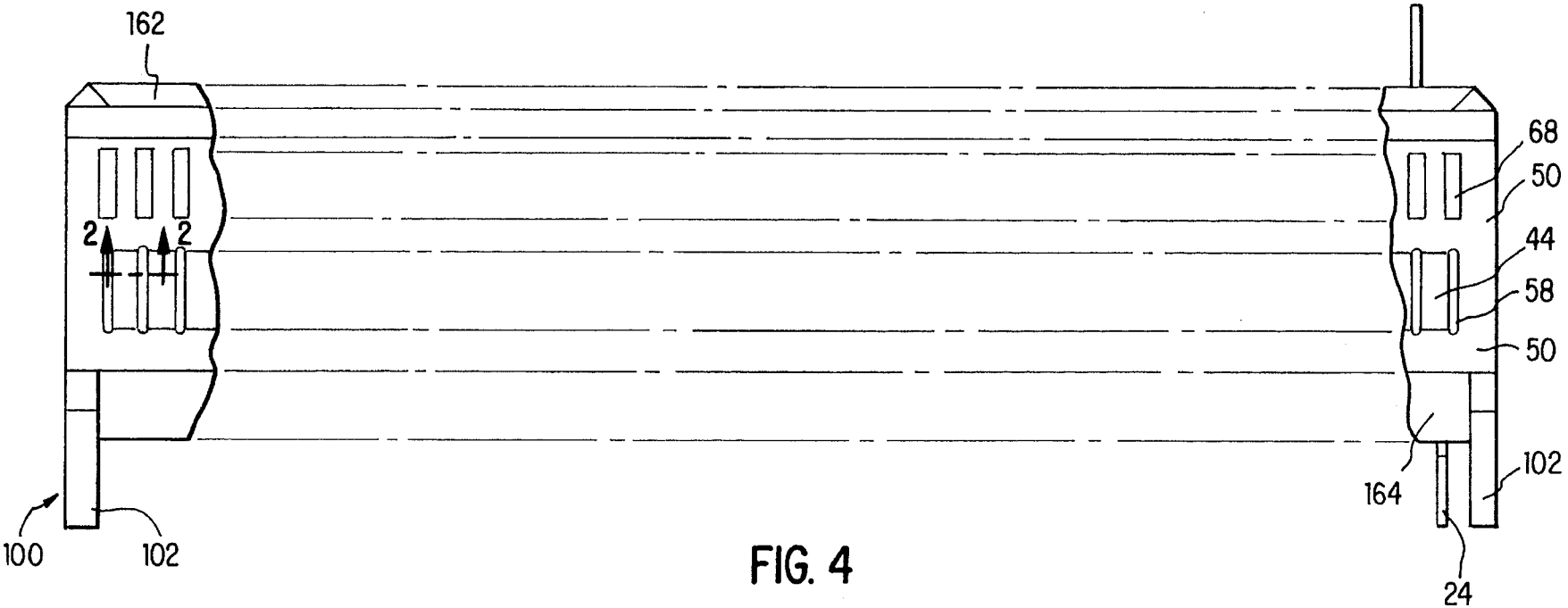
FIG. 4 is a front elevation, partially diagrammatic, of a subassembly of the preferred embodiment.
Figure 6:
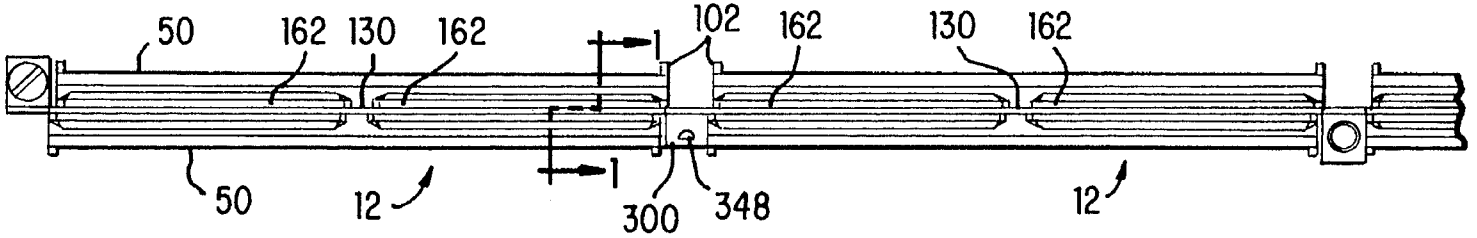
FIG. 6 is a broken-away plan view of the backplane connector of said embodiment.
Figure 7:
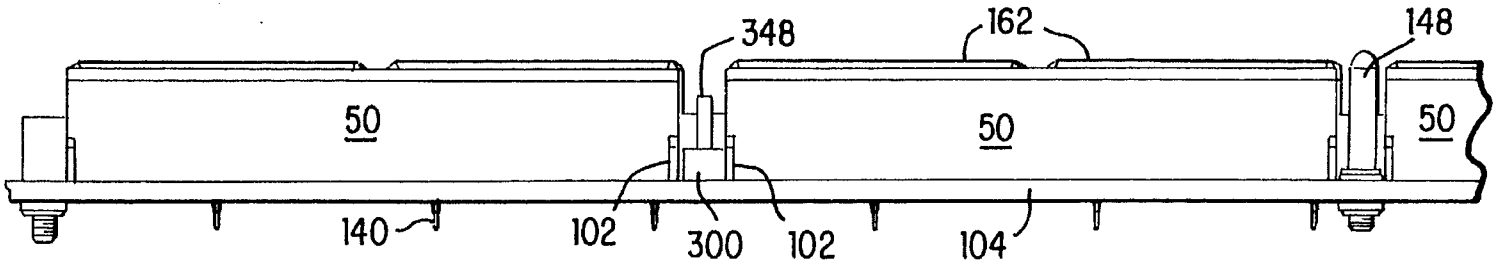
FIG. 7 is a corresponding side elevation view of said backplane connector, with some details omitted, mounted on a printed circuit board.

There are in each of the housings 50 of each connector 12, 14 one fewer of the contact elements 22 than of the contact elements 20. As seen in FIG. 1, in each connector the housings 50 are reversely transversely (vertically, in the figure) oriented. Also, as can be seen in FIGS. 6 and 7 for the backplane connector 12, the housings 50 are longitudinally offset in both connectors 12 and 14. In fact, the parts are arranged (holes, tabs, dimensions) so that this offset is by an amount equal to half the centerline distances between holes 68 and between pads 44 (both of which are on identical centerline spacings), with centerlines of holes 68 and pads 44 arranged to occur alternately, as shown in FIG. 4. So far as the relationship of contact elements 20 and 22 (but not the relationship of tabs 80 and jaws 82) is concerned, FIG. 1 could be a vertical section in a single plane, rather than a section jogged into two planes as drawn in FIGS. 3, 6.

Each contact element 20 includes a daughter board contact portion 24, a lead portion 26, a support portion 28, a beam portion 30, a generally elliptical out-of-round arcuate contact contact portion 32 describing about certain points a circumference encompassing more than 180 degrees, and a second support portion 34 oriented about 90 degrees relative to the first support portion 28.

Figure 2:
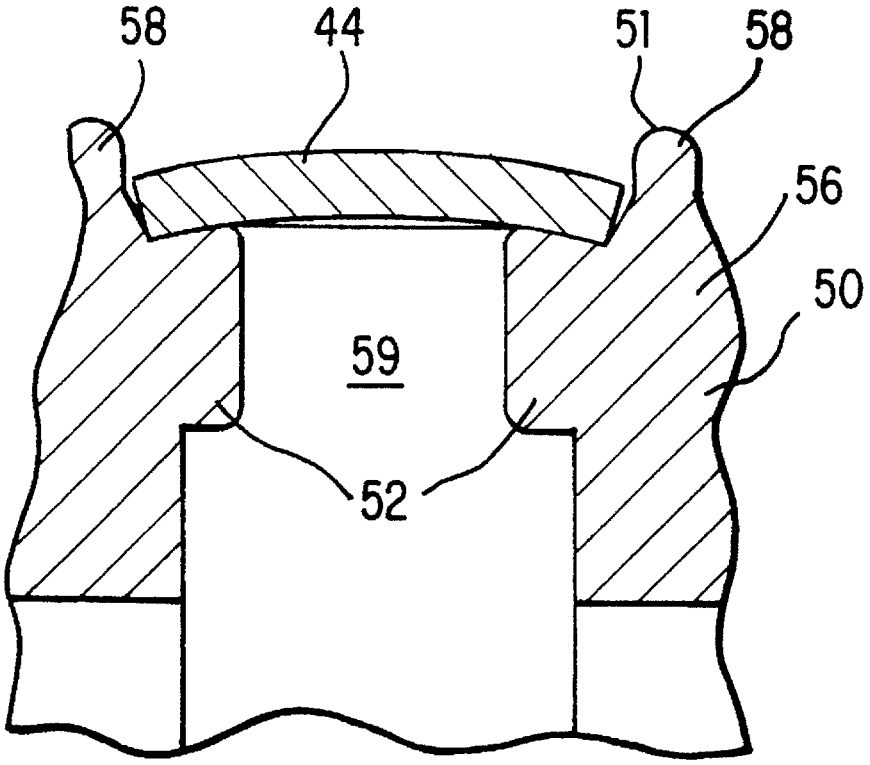
FIG. 2 is a broken-away sectional view taken at 2—2 of FIG. 4.

Each contact element 22 includes a daughter board contact portion 40, a lead portion 42, a pad portion 44 and an end 46. End 46 and lead 42 are anchored in housing 50 (through their position, during injection molding of the housing), and pad 44 is supported by transverse support ribs 52 also injection molded as part of housing 50 and extending over the back of pad 44, generally longitudinally centrally of pad 44, partially inwardly transversely thereof on each rear side thereof. Ribs 52 are injection molded integrally with longitudinal ribs 54, which are integral with plastic portions 56 into which pad ends 46 are anchored. On each side of each pad 44 are ribs 58 molded integrally with plastic portions 56 and the rest of housing 50. Ribs 58 provide outer transversely curved surfaces 57 (FIG. 2) for guidance thereby of contact contact beam portions 32 (which are shaped as cantilevered beams in the illustrated embodiment) onto pads 44 during assembly. Also injection molded in place in housing 50 is lead 42 to each pad 44. Pads 44 extend through holes 59 in housing 50 defined in part by ribs 58. Outer beam support housing portion 62 is spaced from housing rib 54 to provide therebetween space to accept beam portion 28 and lead portion 26, as shown also in FIG. 3. Wider portions 28 are supported on spaced shelves 64 integral with lower portion 62 of housing 50, between which narrower lead 26 moves freely. Beam portions 32, 66 extend through rectangular holes 68 in housing 50 defined by thicker longitudinal ribs 60, outer crook housing portion 65 of housing 50 and longitudinal ribs 54. Thin ribs 70 serve as contact element separators.

In the portion of a subassembly 100 shown in FIG. 4 can be better seen beam contact holes 68, pads 44, and ribs 58 of housing 50. Also shown are legs 102, for resting on a backplane 104 when part of a backplane connector 12, or sticking harmlessly in mid air when part of a daughter board connector 14 (FIG. 1).

Backplane connector 12 has a contact element indicated generally at 122 and which is identical with contact element 22 except that it is bent at a greater angle between portion 42 and its PCB (here backplane) contact portion 122. The other contact element of backplane connector 12, which is indicated generally at 120, is identical with contact element 20, except that it is bent at a greater angle to portion 26 to provide the backplane contact portion indicated generally at 120.

Figure 8:
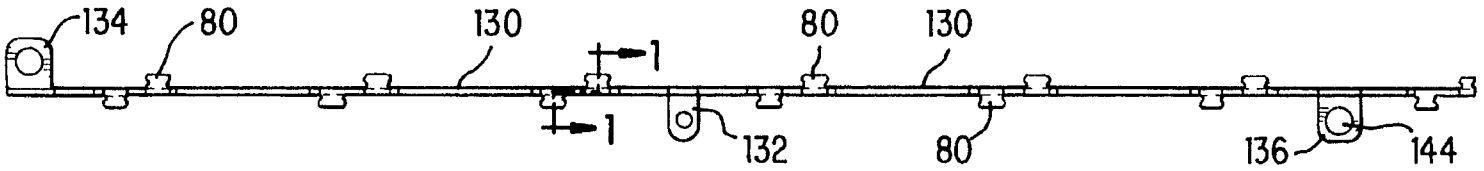
FIG. 8 is a corresponding plan view of the spine element of a modified embodiment.
Figure 9:
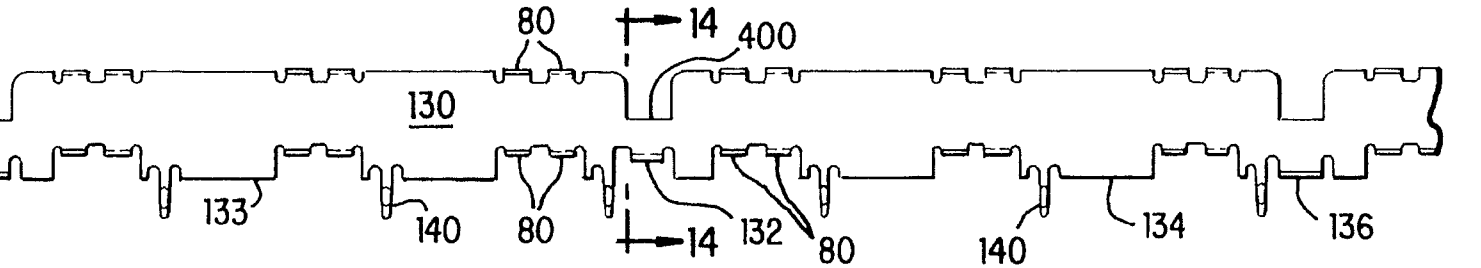
FIG. 9 is a corresponding side elevation view of said spine element.

Housings 50 are supported, and longitudinally located relative to each other, on tabs 80, struck out from metal spine 130, as shown in more detail in FIGS. 8 and 9. (Actually, FIGS. 8 and 9 illustrate the spine of a modification, with tabs 80 entering not only upper portions of housing 50 as in FIG. 1, but corresponding lower portions as well, the lower tabs being substituted for the grips 82 shown in FIG. 1; in the FIG. 1 embodiment the lower tabs of FIG. 1 extend outwardly to a greater distance from the spine, as would be better seen in a figure corresponding with FIG. 8, and have a configuration as would be seen in such a figure with flat longitudinally spaced edges having a transversely convex edge therebetween.)

The spine includes also flange 132 to cooperate in mounting the spine on backplane 104, on which the spine 130 rests on coplanar edge 133 as well.

Spine 130 also includes at each end (one not shown, but extending from the spine in the same transverse direction as the other, shown) an end support flange 134, with a lower surface like the lower surfaces of edge 133 and flange 132 coplanar and resting on backplane 104. Finally is middle support flange 136, struck out from spine 130 like the others, and with lower surface coplanar with theirs and resting on PCB 104 but extending transversely oppositely to flanges 132 and 134 to spine 130.

Extending from the bottom edge of spine 130 are spaced dynamic contact pins 140 integral with the spine, for making compression contact through their elongated slot portions with conductive holes in PCB 104. Mounted in hole 144 of flange 136 (FIGS. 6 and 7), and coaxial hole (not shown) in PCB 104 is guidepost 148.

There are shown in FIGS. 6 and 7 two and a fraction sets of housings 50 of backplane connector 12.

Ridges 162 and 164 (FIGS. 1, 4) are in cross-section half a semicircle on their non-mating (away from contact surfaces of contact elements) sides; and on their other sides at 45 degrees to the plane of nearby surfaces (FIG. 5) 172 (longitudinally continuous) and 174 (longitudinally discontinuous), blending into an extension of the half semicircle already mentioned into three-quarters of a semicircle, or abut 135 degrees. At each end of ridges 162 and 164 the ridges are relieved angling upwardly, as seen for ridge 162 in FIGS. 4 and 5; as seen in FIGS. 6 and 7, each housing 50 includes two ridges 162 and (not there shown) two ridges 164. Relief at the end of each ridge 162 and 164 is by planes through the back halves of the ridges at angles of 90 degrees to both the faces 172, 174 and 45 degrees to the ends of the housings, and through the front halves of the ridges by planes at 45 degrees to the faces 172, 174 and to the ends of the housings as well. The relieved portions at the ends of ridges 162, 164 are for crimping thereinto the inwardly extending upper and lower portions of tracks 220, to further secure relative thereto housings 50.

Extending into the backs, or non-mating, sides (FIG. 5) of housing 50 are rectangular blind holes 168 extending from surfaces 172 partially through housing 50. Hole locations 168 are longitudinally spaced as are upper tabs 80 in the embodiment of FIG. 1, lower tabs 80 of FIG. 8 being replaced by the different tabs 82 as shown in FIG. 1 and already explained. As shown in FIG. 1, tabs or grips 82 are crimped around ridges 164 (after inserting tabs 80 and moving housing 50 into position).

Figure 5:
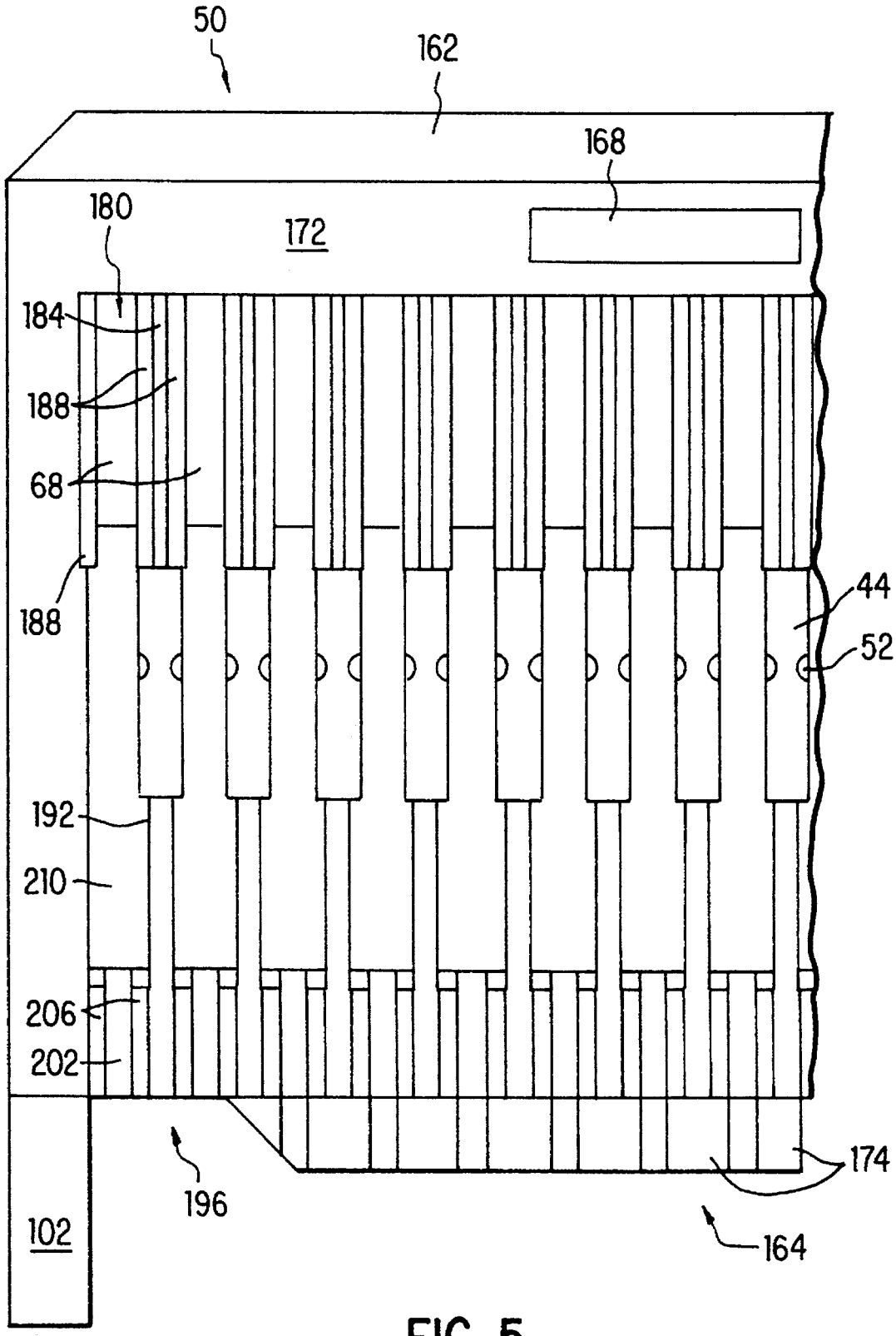
FIG. 5 is a rear elevation, broken away and to a larger scale, of the subassembly of FIG. 4.

Also shown in FIG. 5 are ribs indicated generally at 180, each rib including a narrow outer surface 184 coplanar with surface 172. From each of the two edges of surface 184 extend a pair of guide surfaces 188 widening therebetween in a 45 degree chamfer.

Between guide surfaces 188 are a row of holes 68 through which extend frontwardly (FIG. 1, not shown in FIG. 5) the cantilever beam contact portions 66.

Beneath pads 44 are narrow ribs 192 integrally injection molded with the rest of housing 50 separating beam portions 30 of contact elements 20 and 120. Integral with narrow ribs 192 are wide ribs indicated generally at 196 with central flat surfaces 202 coplanar with the outer surface of narrow ribs 192, and with 45 degree chamfer 206. Between the ribs 196 extend contact element portions 26 (FIG. 1).

Above the wide ribs 196 in this view is housing portion 210.

Daughter board connector 14 includes opposed housings 50 incorporating contact elements as seen identical in form (except for the angle of bend of their daughter board contact portions, already mentioned) and arrangement with the housing subassemblies in backplane connector 12.

These subassemblies are slidably mounted on mating ridges 162, 164 in long, extruded aluminum track elements 220, simply cut to the desired length.

The contact element portions 24, 40 and 42, 26 are soldered on soldered surface mounting pads carried in a way conventional in the art on, respectively, daughter board 250 and backplane 104.

Figure 10:
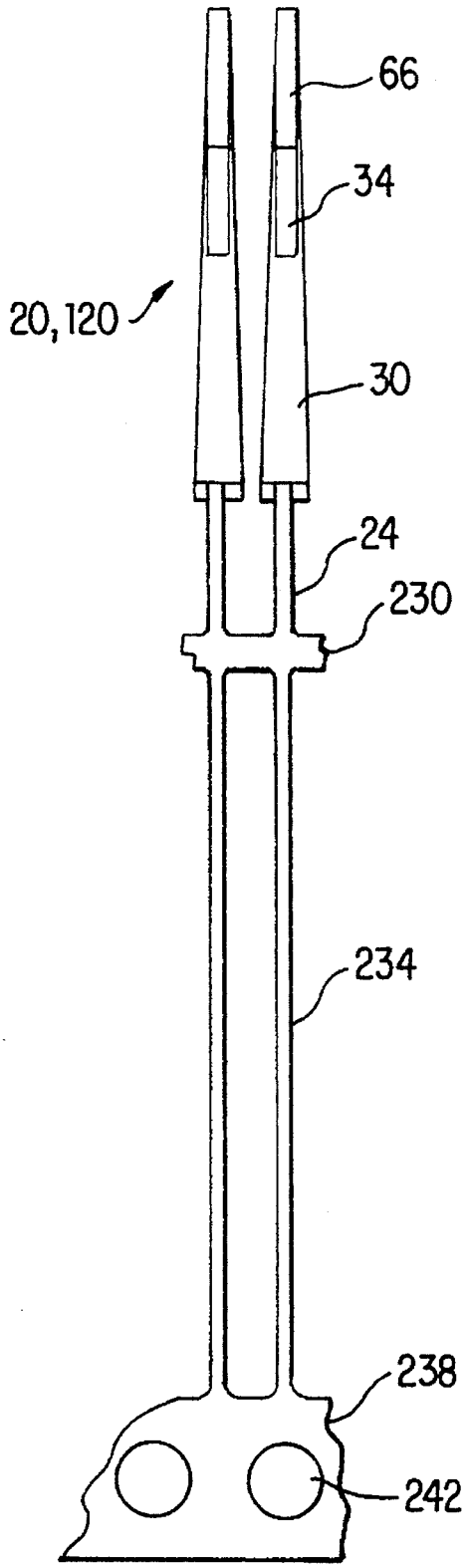
FIG. 10 is a side elevational broken-away view of a web adapted for winding on a reel, showing two beam contact elements of the invention.

In FIG. 10 is seen a pair of shepherd's crook beam contact element 20, 120 precursors, while still integral through ribs 230, 234 with drive wheel contact portion 238, through which extend drive wheel pin receiving holes 242. The blanks for what will become pad contact elements 22, 122 are also prepared in reels to facilitate handling.

Figure 11:
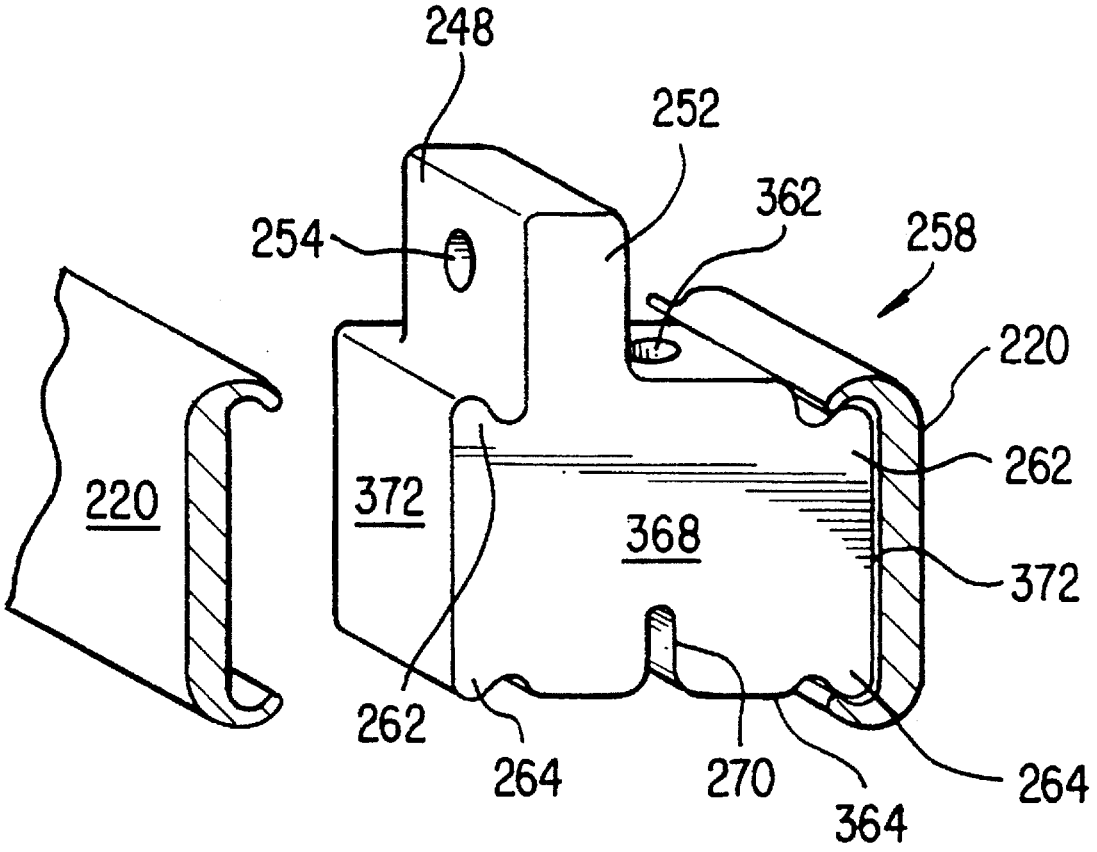
FIG. 11 is an isometric, partial, partially exploded view of a daughter-board-supporting spacer and the rails carried by it.

Daughter boards 250 are held (against ear 252 surface 248) by screws (not shown) extending into threaded (not shown) holes 254 in extruded aluminum spacers indicated generally at 258 (FIG. 11) including ridges 262, 264 shaped and spaced just as are ridges 162, 164 for alinement thereal-long in the holding tracks 220. Also extruded into spacer 258 is groove 270, extending down to just above the top surface 272 of spine 130, for accepting spine 130 in notch 400, to align spacer 258. A spacer 258 is provided along tracks 220 between each longitudinally adjoining pair of housings 50, as well as outboard of each outermost such pair; in the preferred embodiment are four pairs of such housings and thus five spacers 258.

Figure 12:
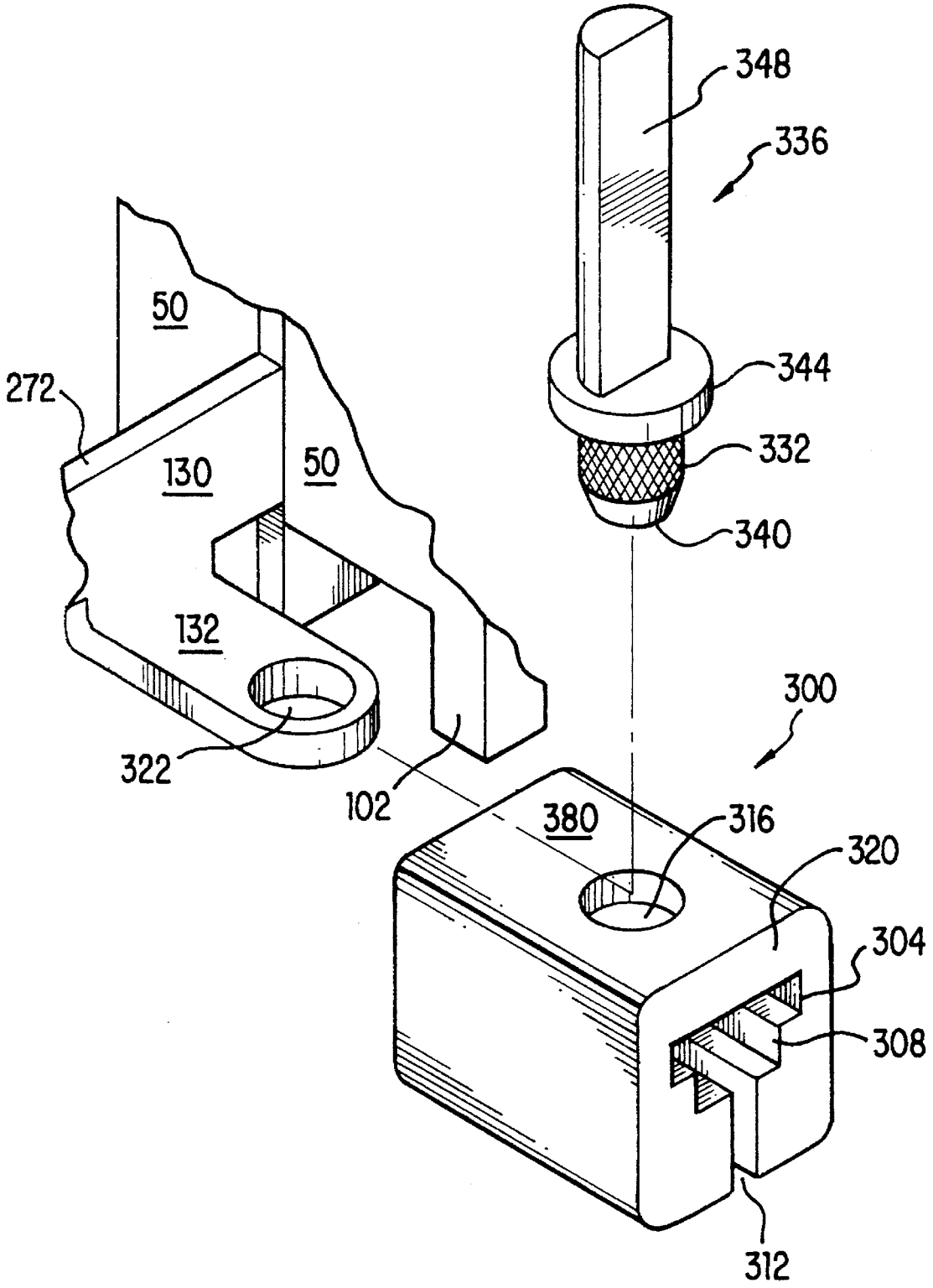
FIG. 12 is an exploded isometric view, partially broken away, of a backplane spine of the preferred embodiment carrying a pair of housings and arranged to accept a D-pin carrying block.

Mounted on each of tabs 132, one on each side of tab 136 and both extending transversely of spine 130 in the same transverse direction, are (FIG. 12) extruded aluminum key blocks indicated generally at 300, through which in a transverse direction extend a wide slot 304, a narrower notch 308 opening thereinto, and a slot 312 opening into notch 308.

Force fitted in both hole 316 extending through upper portion 320 of key block 300 and hole 322 extending through tab 132, thereby precisely relatively locating key block 300 and spine 130, is generally cylindrical knurled lower end portion 332 of D-pin key indicated generally at 336, with frustoconical guidance chamfer 340 and integral bottoming ring 344 and D-pin 348. The bottom of key pin 336 extends into notch 308 just enough to account for chamfer 340 and tolerances, to get full knurled contact with tab 132 and portion 320. Slot 312 facilitates manufacture by extrusion. Although not shown, all the inner corners of slot 304, notch 308, and slot 312 are provided with radii to facilitate extrusion and assembly.

Figure 13:
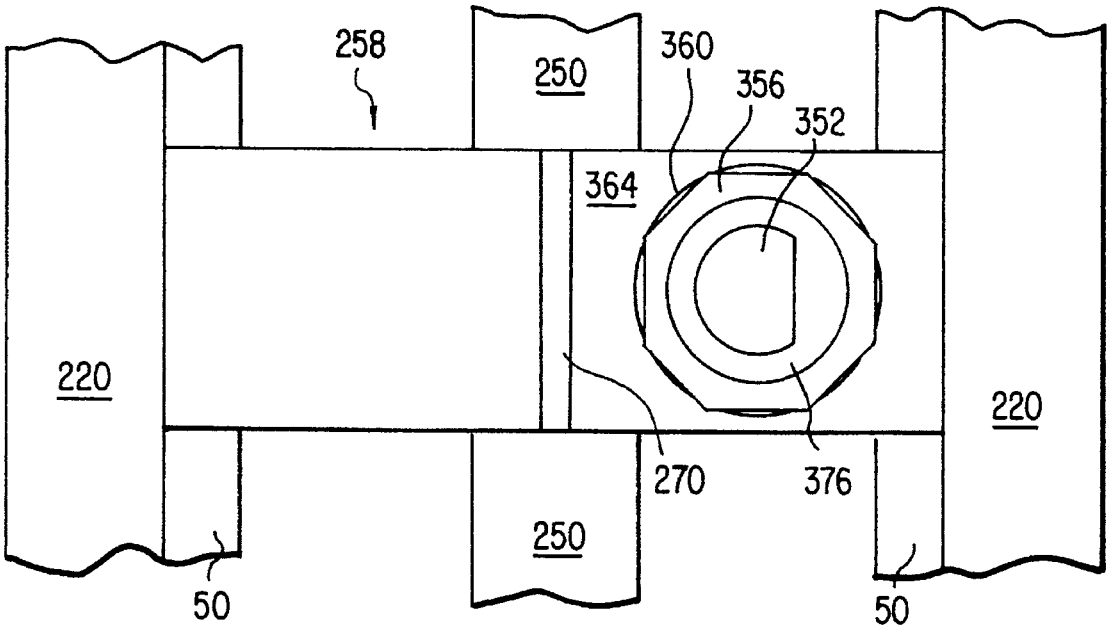
FIG. 13 is a bottom view, broken away and partially diagrammatic, of the daughter board connector of said preferred embodiment.

A D-pin 348 fits locatingly into a D-hole 352 (FIG. 13) extending upwardly into sintered stainless steel octagonal insert 356 force fitted into counterbore 360 to bottom thereon in spacer 258 at abut a third of the spacer height above bottom surface 364, the counterbore 360 and hole 362 (FIG. 11) coaxial centerline being halfway between the two flat surfaces 368 and halfway between notch 270 and the ridges 262, 264 farther from ear 252 and extending parallel to all four surfaces 368, 372. Octagonal insert 356 includes pin guide countersink 376 and may be with D-pin 348 rotationally oriented as desired to affect pin mating.

Bottom surface 364 of spacer 258 engages top surface 380 of key block 300 in each instance, to provide important locating orientation among the parts of the overall assembly.

Post or guide pin 148 (FIGS. 6, 7) at its upper end is accepted by hole 362 in spacer 258, to index backplane 104 to daughter board 250.

The beam contact members 20, 120 are supplied to customers still connected by the bar 230 (FIG. 10); after soldering 24 or 120 to a PCB pad, they may then break off leads 24, for example, at score lines (not shown) conveniently placed just outboard of where they are soldered to the board pads.

Representative dimensions of the preferred embodiment are, in millimeters: housing 50, longitudinally 71.5, and transversely, centrally, 3.4; track 220, transversely, outside 12.93 by 3.7; beam 30 length 7.16, crook 32, 66 major axis (about) 2.7, and trapezoid 30 tapering from 0.71 to 0.31; leads 24 0.25 wide (longitudinal of housing) by 0.20 thick; and block 300 slot 304, longitudinally of spine, 3.5 and slot 312 (in the same direction) 1.2; leads 24, beams 30, and pads 58 are each on 1.0 centerlines.

Other Embodiments

The leads extending from the top in FIG. 1 could be shaped like the leads extending from the bottom, whereupon a connector assembly for stacked PCB's would result. Or those at the bottom could be shaped like those at the top, to connect boards in line rather than either perpendicular or parallel.

Each contact element could include a beam contact portion to contact that of the other; one contact portion surface might have its contact surface cylindrically concave to engage a convex cylindrical surface of the other.

The single row of tabs 80 left remaining in FIG. 1 could be replaced with a second row of jaws 82 cooperating with mating notches in at least one of the ridges 162, 164 in order for relative longitudinal location as well as holding of the housings.

Spacing, securing, and mounting may be in other ways.

Figure 14:
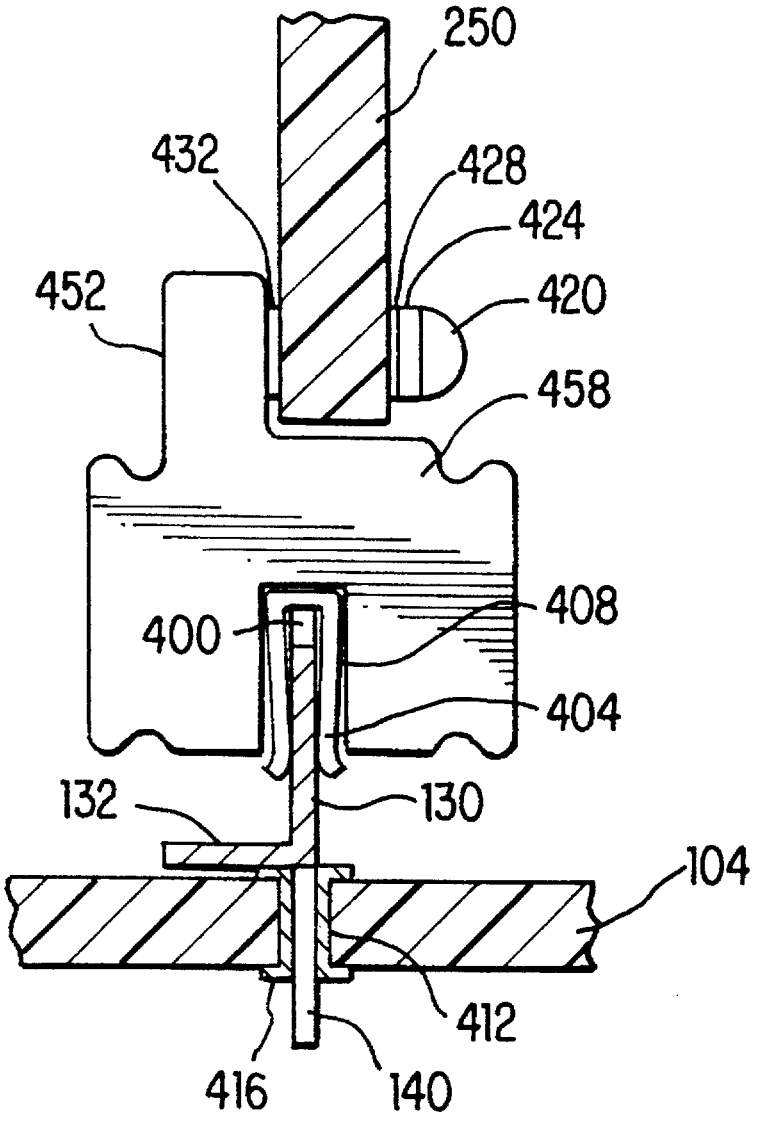
FIG. 14 is a sectional view taken at 14—14 of FIG. 9.

A further important embodiment is shown in FIG. 14. Female contact 404 is press-fitted in enlarged slot 408 of spacer 458, otherwise like spacer 258. Plated through hole 412 of backplane 104 provides the usual spool-shaped conductive coating element 416. Head 420 of a screw extending through daughter board 250 and into a threaded hole in ear 452 (which is identical with ear 252) rests on metal washer 424, which engages in turn lip 428 of a plated through conductive spool like 416, the other lip or flange of which is shown at 432. There is thus a conductive path from daughter board 250 through lip 432 and extruded aluminum spacer 452, 408 through contact 404, spine 130, 132 and spool 416 to backplane 104, a path highly suitable for use as a ground path.

Still other embodiments are within our claims.

Fixture

Figure 15:
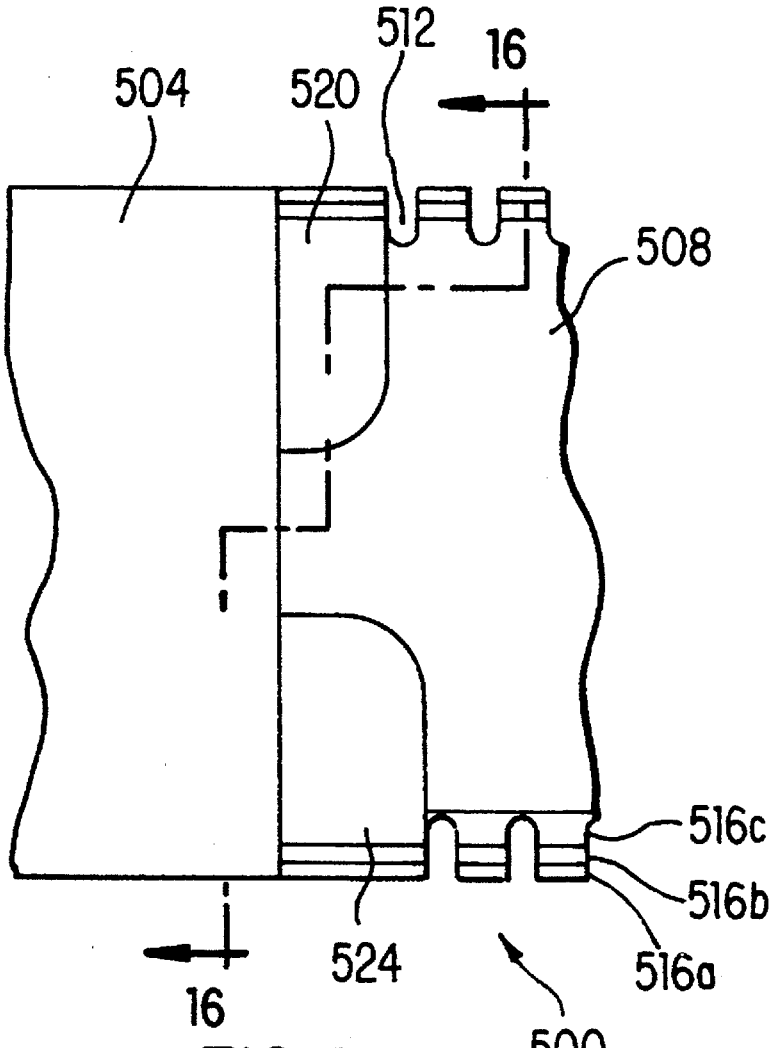
FIG. 15 is a partial plan view of a fixture for assembling the daughter board connector of the preferred embodiment.
Figure 16:
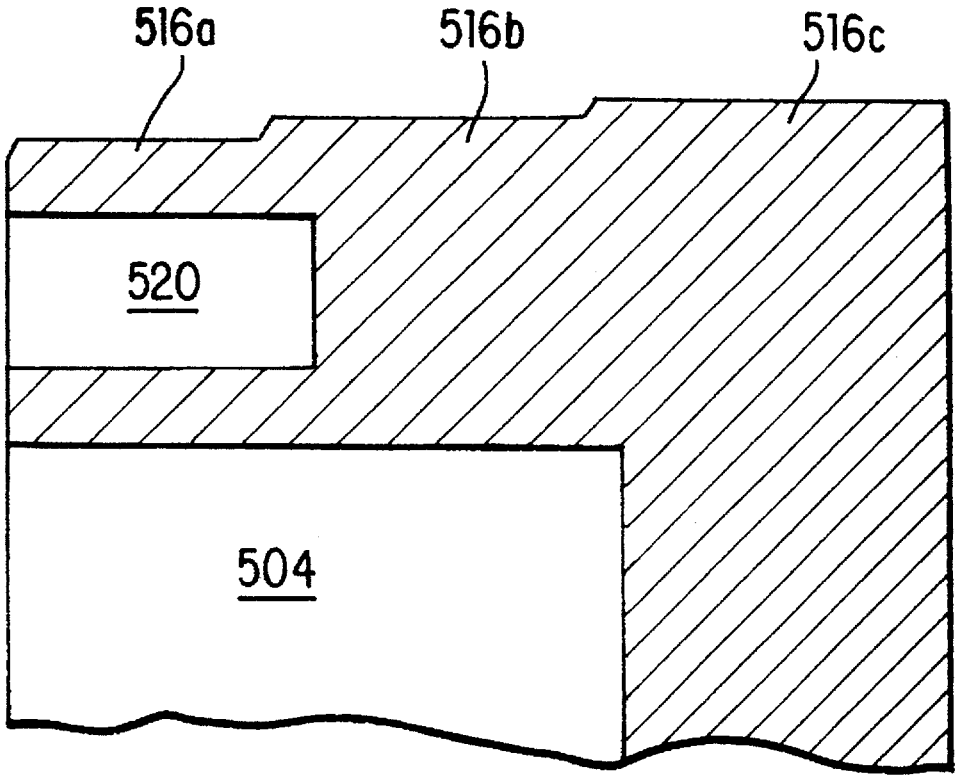
FIG. 16 is a sectional view taken at 16—16 of FIG. 15.

A fixture useful in assembly of daughter boards according to the preferred embodiment is shown in FIGS. 15 and 16.

There is shown in FIG. 15 a bar indicated generally at 500. Illustrated is part of one spacer 258 accepting notch 504 and one subassembly accepting portion 508. For the preferred embodiment the bar includes four portions 508 and five portions 504, with a portion not shown and like portions 508 except shorter and without grooves 512. Grooves 512 are defined by rectilinear ribs 516, which include stepped portions 516*a*, 516*b*, and 516*c*. Recesses 520, 524 allow for acceptance of housing legs 102.

Housings are fitted on jig 500 with ribs 58 in grooves 512 and ribs 516 toward pads 44. Once positional relationships are set, tracks 220 are crimped to fix these relationships. Bar 500 may then be removed downwardly.

We claim:

1. An electrical connector comprising:

a) an insulative housing having a face;

b) a first plurality of contacts extending through the housing, each of the first plurality of contact elements including a contact pad with the contact pads disposed in a first line across the face;

c) a second plurality of contact elements extending through the housing, each of the second plurality of contact elements including a beam extending through the face with the beams disposed in a second line across the face.

2. The electrical connector of claim 1 wherein the first line and the second line are parallel.

3. The electrical connector of claim 2 wherein the first plurality of contact elements and the second plurality of contact elements are offset so that pads of the first plurality of contact elements are between beams of the second plurality of contact elements.

4. The electrical connector of claim 1 wherein the housing additionally comprises a plurality of ribs disposed on the face between adjacent contact pads.

5. The electrical connector of claim 1 wherein the first plurality of contacts is injection molded within the housing.

6. The electrical connector of claim 1 wherein the face has a plurality of openings therethrough disposed along the second line and each of the beams projects through an opening, there being at least one more opening than beams.

7. The electrical connector of claim 1 wherein each of the first plurality and second plurality of contact elements additionally comprises a contact for soldering to a printed circuit board.

8. A backplane electrical connector comprising:

a) a metal spine having features for mounting to a backplane, the spine having a flat portion extending perpendicular to the backplane;

b) a plurality of housings attached to the backplane, each of the housings having a face pointing away from the flat portion of the spine and at least one additional surface;

c) a plurality of contact elements extending through the housing, each of the contact elements having a first contact portion extending through the face and a printed circuit board contact portion projecting through the additional surface.

9. The backplane electrical connector of claim 8 wherein the flat portion has a first side and a second side and a portion of the plurality of housings are mounted on the first side and a portion of the plurality of housings is mounted on the second side.

10. The backplane electrical connector of claim 8 wherein the spine comprises grip portions and the housing comprises a ridge and the grip portions are crimped around the ridge.

11. The backplane electrical connector of claim 8 wherein the contact portion of the plurality of contact elements extend through the face in two rows, with contact portions in a first row being shaped as pads and the contact portions in a second row being shaped as a cantilevered leaf spring.

12. The backplane electrical connector element of claim 8 additionally comprising means for connecting the spine to ground.

13. The backplane electrical connector element of claim 12 wherein the means for connecting the spine to ground comprises a contact pin extending through a hole in the backplane.

14. The backplane electrical connector of claim 12 additionally comprising guide posts attached to the spine.

15. The backplane electrical connector of claim 11 wherein adjacent beams and adjacent pads are spaced apart 1 millimeter on centerline.

16. The backplane electrical connector of claim 8 additionally comprising pins extending from the spine into the printed circuit board.

17. An electrical connector comprising:

a) a first rail;

b) a second rail;

c) a plurality of spacers joining the first rail and the second rail; and d) a plurality of insulative housings sub-assemblies inserted into the first and second rails, each insulative housing sub-assembly comprising:

i) an insulative housing having a face and at least one additional surface;

ii) a plurality of contact elements extending through the insulative housing, each contact element having a contact portion extending through the face and a printed circuit board contact portion extending from the additional surface.

18. The electrical connector of claim 17 wherein the contact portions of a portion of the plurality of contact elements are pads.

19. The electrical connector of claim 17 wherein the contact portions of a portion of the plurality of contact elements are beams.

20. The electrical connector of claim 17 wherein the spacers have holes extending therethrough.

21. The electrical connector of claim 17 wherein each of the spacers has at least two sides and a first side has a ridge disposed within the first rail and the a second side has a ridge disposed within the second rail.

22. The electrical connector of claim 17 wherein at lest a portion of the spacers include means for mounting the electrical connector to a printed circuit board.

23. The electrical connector of claim 17 wherein the housing sub-assemblies are disposed within the first and second rails such that the faces of the housing sub-assemblies within the first rail are directed toward the faces of the housing sub-assemblies in the second rail.

24. An electrical connector comprising:

a) a plurality of sub-assemblies each comprising:

i) an insulative housing having a face and at least one additional surface, ii) a first plurality of contact elements disposed within the insulative housing, said contact elements having contact portions disposed on the face;

iii) a second plurality of contact elements disposed within the insulative housing, said contact elements having contact portions disposed on the face;

b) a first support member having a first surface, wherein a portion of the plurality of sub-assemblies are attached to the first surface, c) a second support member having a surface, wherein a portion of the plurality of sub-assemblies is attached to said surface;

d) wherein the first plurality of contact elements of the sub-assemblies attached to the first support member engage the second plurality of contact elements of the sub-assemblies attached to the second support member and the second plurality of contact elements of the sub-assemblies attached to the first support member engage the first plurality of contact elements of the sub-assemblies attached to the second support member.

25. The electrical connector of claim 24 wherein the contact portions of the first plurality of contact elements are shaped differently than the contact portions of the second plurality of contact elements.

26. The electrical connector of claim 24 wherein the contact portions of the first plurality of contact elements are beams and the contact portions of the second plurality of contact elements are pads.

27. The electrical connector of claim 24 wherein the insulative housings of the sub-assemblies attached to the first support member and the second support member are identical.

28. The electrical connector of claim 27 wherein, for each sub-assembly, the contact elements of the first plurality of contact elements are disposed in a first line and the contact elements of the second plurality of contact elements are disposed in a second line.

29. The electrical connector of claim 28 wherein the first plurality of contact elements are beams and each of the insulative housing has holes through face disposed along the first line with a beam projecting through each hole and there are more holes in the first line than there are beams.

30. The electrical connector of claim 29 wherein the beams in each sub-assembly are disposed in adjacent holes, leaving at least one empty hole at the end of the first line and the sub-assemblies attached to the first support member have an empty hole at a first end of the line and the sub-assemblies attached to the second support member have an empty hole at a second end of the line.

31. The electrical connector of claim 24 wherein the first support member has a second surface, parallel with the first surface and a portion of the plurality of sub-assemblies is attached to the second surface, the faces of the sub-assemblies mounted to first surface pointing in the opposite directions as the faces of the sub-assemblies mounted to the second surface.

32. The electrical connector of claim 31 additionally comprising a third support member, joined to the second support member, and wherein a portion of the plurality of sub-assemblies is mounted to the third support member.

33. The electrical connector assembly of claim 32 wherein the sub-assemblies attached to the first support member are disposed between the sub-assemblies attached to the second support member and the sub-assemblies attached to the third support member.

34. The electrical connector of claim 33 wherein, for each sub-assembly, the first plurality of contact elements has beam shaped contact portions and the second plurality of contact elements has pad shaped contact portions and the beams of the sub-assemblies on the first support member engage pads on the sub-assemblies attached to the second and third support members.

35. The electrical connector of claim 24 wherein the first and second support members are electrically connected together.

* * * * *